US011065883B2

(12) United States Patent
Chen et al.

(10) Patent No.: US 11,065,883 B2
(45) Date of Patent: Jul. 20, 2021

(54) CROSS-DIE RECIRCULATION CHANNELS AND CHAMBER RECIRCULATION CHANNELS

(71) Applicant: HEWLETT-PACKARD DEVELOPMENT COMPANY, L.P., Spring, TX (US)

(72) Inventors: Chien-Hua Chen, Corvallis, OR (US); Jeffrey R. Pollard, Corvallis, OR (US); Michael W. Cumbie, Corvallis, OR (US); Si-Lam Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,045

(22) PCT Filed: Nov. 27, 2017

(86) PCT No.: PCT/US2017/063275
§ 371 (c)(1),
(2) Date: Sep. 11, 2019

(87) PCT Pub. No.: WO2019/103752
PCT Pub. Date: May 31, 2019

(65) Prior Publication Data

US 2020/0282738 A1 Sep. 10, 2020

(51) Int. Cl.
*B41J 2/18* (2006.01)

(52) U.S. Cl.
CPC ..... *B41J 2/18* (2013.01)

(58) Field of Classification Search
CPC ..... B41J 2/18; B41J 2202/12
See application file for complete search history.

(56) References Cited

U.S. PATENT DOCUMENTS 5,017,941 A 5/1991 Drake
8,616,689 B2 12/2013 Von Essen et al.
9,090,084 B2 * 7/2015 Govyadinov ..... B41J 2/14201
(Continued)

FOREIGN PATENT DOCUMENTS

CN 103153625 6/2013
CN 103781630 5/2014
(Continued)

OTHER PUBLICATIONS

Through-channel Ink Recirculation, May 7, 2017, http://www.iacs.be.through-channel-ink-recirculation.html

*Primary Examiner* — Sharon Polk
(74) *Attorney, Agent, or Firm* — Fabian VanCott

(57) ABSTRACT

A die may, in an example, include at least one cross-die recirculation channel formed into the die to recirculate an amount of printing fluid therethrough, the cross-die recirculation channel including a first-sized inlet port and a first-sized outlet port formed on a first side of the die, at least one chamber recirculation channel formed into the die and fluidically coupled to the cross-die recirculation channel to recirculate an amount of printing fluid therethrough, the chamber recirculation channel including a second-sized inlet port and a second-sized outlet port, at least one pump formed within the chamber recirculation channel to recirculate the amount of printing fluid therethrough.

20 Claims, 10 Drawing Sheets

(56) References Cited

U.S. PATENT DOCUMENTS

| | | | | |
|---|---|---|---|---|
| 9,162,453 | B2 | 10/2015 | Cruz-Uribe et al. | |
| 9,623,659 | B2 | 4/2017 | Govyadinov et al. | |
| 9,724,926 | B2 | 8/2017 | Keefe et al. | |
| 2010/0321444 | A1 | 12/2010 | Xie | |
| 2010/0328402 | A1 | 12/2010 | Xie et al. | |
| 2012/0007921 | A1* | 1/2012 | Govyadinov | B41J 2/1404 347/54 |
| 2013/0162725 | A1 | 6/2013 | Suzuki et al. | |
| 2015/0091989 | A1 | 4/2015 | Govyadinov et al. | |
| 2017/0157945 | A1 | 6/2017 | Govyadinov et al. | |

FOREIGN PATENT DOCUMENTS

| | | |
|---|---|---|
| CN | 103826860 | 5/2014 |
| JP | 2013103485 | 5/2013 |
| JP | 2013532594 | 8/2013 |
| JP | 2014151528 | 8/2014 |
| JP | 2014522756 | 9/2014 |
| JP | 2017124615 | 7/2017 |
| JP | 2017140806 | 8/2017 |
| JP | 2017144571 | 8/2017 |
| JP | 2017144634 | 8/2017 |

* cited by examiner

CROSS-DIE RECIRCULATION CHANNELS AND CHAMBER RECIRCULATION CHANNELS

BACKGROUND

Printing devices implement dies to eject printing fluid onto the surface of a print media. The printing fluid, in some examples, may include pigments that provide color to the printing fluids. Other solids may also be present in the printing fluid.

BRIEF DESCRIPTION OF THE DRAWINGS

The accompanying drawings illustrate various examples of the principles described herein and are part of the specification. The illustrated examples are given merely for illustration, and do not limit the scope of the claims.

DETAILED DESCRIPTION

Figure 1:
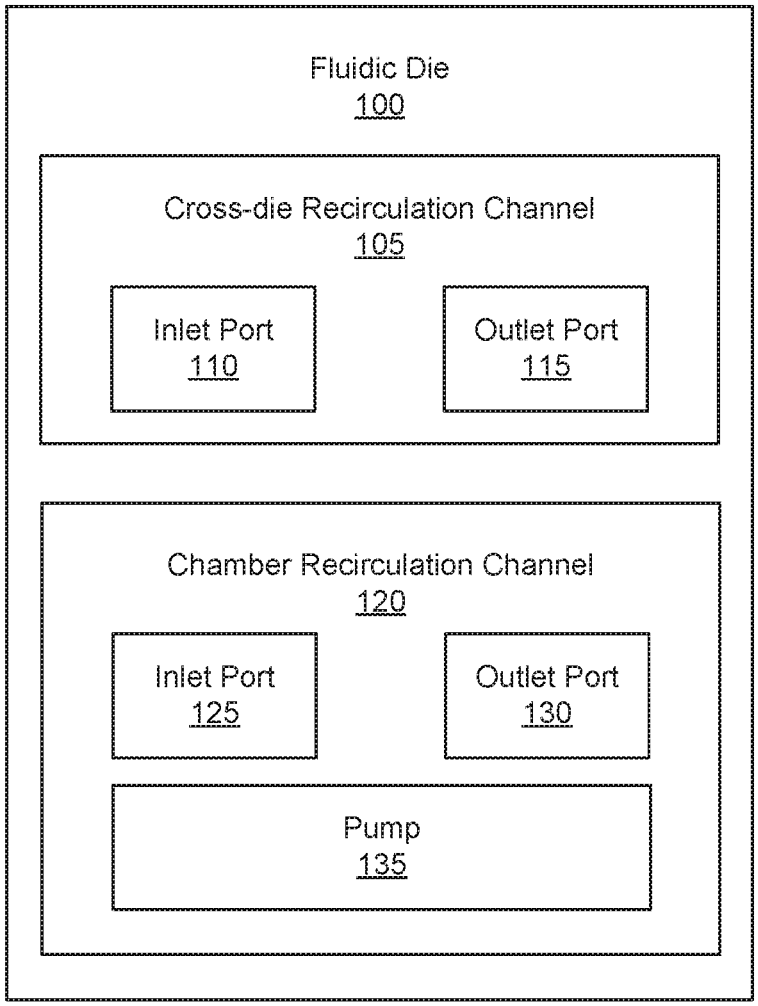
FIG. 1 is a block diagram of a die according to an example of the principles described herein.

Some fluids used in fluid ejection devices may include a number of solids maintained in a liquid carrier. These solids may include, for example, pigments, cells, conglomerations of solids within the fluid, water based ultra-violet fluids, among others. During operation of the fluid ejection device, the solids may settle within the fluid chambers and/or channels formed within a die of the fluid ejection device. This settling of the solids may cause fluid ejection defects as a result a higher concentration of liquid carrier being ejected out of the die than the solids.

In some examples the fluid ejection device is a printing fluid ejection device. These types of devices may include cartridges, page-wide arrays of fluidic dies, among other printing fluid ejection devices, In these examples, printing fluid may be circulated from a printing fluid reservoir, through the printing fluid ejection device, out of an orifice, and onto a print media. The printing fluid may include inks, toners, varnishes, powders, colorants, finishes, gloss enhancers, binders, and/or other such materials that may be utilized in a printing process.

The present specification describes a die that includes at least one cross-die recirculation channel formed into the die to recirculate an amount of printing fluid therethrough, the cross-die recirculation channel including a first-sized inlet port and a first-sized outlet port formed on a first side of the die, at least one chamber recirculation channel formed into the die and fluidically coupled to the cross-die recirculation channel to recirculate an amount of printing fluid therethrough, the chamber recirculation channel including a second-sized inlet port and a second-sized outlet port, and at least one pump formed within the chamber recirculation channel to recirculate the amount of printing fluid therethrough.

The present specification also describes a device that includes at least one cross-die recirculation channel formed into a silicon die fluidically coupled to an inlet port and an output port of at least one chamber recirculation channel formed into the silicon die, a firing chamber formed along the at least one chamber recirculation channel, and at least one device formed along a portion of the at least one chamber recirculation channel to drawn an amount of printing fluid from the cross-die recirculation channel and through the firing chamber.

The present specification further describes a fluid ejection system that includes a fluid reservoir to maintain an amount of printing fluid therein, at least one cross-die recirculation channel formed into a silicon die to recirculate an amount of the printing fluid therethrough, the cross-die recirculation channel including a first-sized inlet port and a first-sized outlet port formed on a first side of the silicon die, at least one chamber recirculation channel formed into the silicon die and fluidically coupled to the cross-die recirculation channel to recirculate an amount of the printing fluid therethrough, the chamber recirculation channel including a second-sized inlet port and a second-sized outlet port, and at least one pump formed within the chamber recirculation channel to recirculate the amount of the printing fluid therethrough.

Example fluid ejection devices described herein may be implemented in printing devices, such as two-dimensional (2D) printing devices and/or three-dimensional (3D) printing devices. In some examples, a fluid ejection device may be implemented into a printing device and may be utilized to print content onto a media, such as paper, a layer of powder-based build material, reactive devices (such as lab-on-a-chip devices), among others. Example fluid ejection devices include ink-based ejection devices, digital titration devices, and 3D printing devices, among others. For ease of description, however, the present specification may use the example of a 2D printing device. This is not meant to be limiting and the present specification contemplates the use of the systems, devices, and methods described herein in connection with the ink-based ejection devices, digital titration devices, and 3D printing devices as well.

Turning now to the figures, FIG. 1 is a block diagram of a fluidic die (100) according to an example of the principles described herein. The die (100) may include a number of cross-die recirculation channels (105) and a number of chamber recirculation channels (120). In an example, a cross-sectional area of each of the cross-die recirculation channels (105) may be relatively larger than the cross-sectional area of each of the chamber recirculation channels (120). In this example, the cross-sectional area of the cross-die recirculation channels (105) may be on the order of $10^{-5}$ $mm^2$ or larger while the cross-sectional area of the chamber recirculation channels (120) may be on the order of $10^{-5}$ $mm^2$ or smaller. In an example, the cross-sectional areas of the both the cross-die recirculation channels (105) and the chamber recirculation channels (120) are the same.

In an example, the cross-die recirculation channels (105) may each pass through, at least, a portion of the die (100). The cross-die recirculation channels (105) may have a first-sized inlet port (110) sized similar to the size of the cross-die recirculation channels (105). In this example, the cross-die recirculation channels (105) may further include a first-sized outlet port (115) sized similar to the cross-die recirculation channels (105). The first-sized inlet port (110) and first-sized outlet port (115) allow for the intake and output of fluid into and out of the die (100). Additionally, the cross-die recirculation channels (105) with its first-sized outlet port (115) and first-sized inlet port (110) form part of a total recirculation system within the die (100) to recirculate the fluid within. Recirculation of the fluid within the die (100) prevents the pigments from settling within the fluid thereby increasing the quality of print during a printing operation.

In an example, the cross-die recirculation channels (105) may create a lateral cross flow across the die (100) to connect the chamber recirculation channels (120) to the cross-die recirculation channels (105). The lateral cross-flow may include cross-die recirculation channels (105) that run a length of the die (100). In an example, the cross-die recirculation channels (105) run longitudinally across the die to connect the chamber recirculation channels (120) to the cross-die recirculation channels (105). Accordingly, the formation of the cross-die recirculation channels (105) within the die (100) provides for a number of layouts of the cross-die recirculation channels (105) and chamber recirculation channels (120) within the die (100). Examples include a number of cross-die recirculation channels (105) that form an enclosed slot in the silicon die, a slanted enclosed slot in the silicon die, a spaced rib pattern in the silicon die, a slanted spaced rib pattern in the silicon die, a spaced post pattern in the silicon die, a slanted spaced post pattern in the silicon die, a chevron slot pattern in the silicon die, a chevron rib pattern in the silicon die, a chevron post pattern in the silicon die, a membrane pattern in the silicon die, a vertical rib pattern in the silicon die, a vertical rib pattern in the silicon die, or combinations thereof.

The cross-die recirculation channels (105) may fluidically couple any number of reservoirs to the chamber recirculation channels (120). Each of the number of reservoirs may include distinct fluids. In an example, the distinct fluids may include different types of printing fluids and/or different colors of printing fluids. In an example, first group of cross-die recirculation channels (105) may be provided with a first type and/or color of printing fluid while a second group of cross-die recirculation channels (105) may be provided with a second type and/or color of printing fluid. Additional numbers of types and/or colors of printing fluid may be used in the connection with the die (100) and the present specification contemplates such use.

The chamber recirculation channels (120) may include a second-sized inlet port (125) and a second-sized outlet port (130) sized similar to the size of the chamber recirculation channels (120). In this example, the chamber recirculation channels (120) may further include a second-sized outlet port (130) sized similar to the chamber recirculation channels (120). The second-sized inlet port (125) and second-sized outlet port (130) allow for the intake and output of fluid into and out of the die (100). Additionally, chamber recirculation channels (120) with its second-sized inlet port (125) and second-sized outlet port (130) form part of the total recirculation system within the die (100) described herein in order to recirculate the fluid within the die (100).

The chamber recirculation channels (120) may include a number of pump (135). The pumps (135) may be microfluidic pumps that pull an amount of fluid from the cross-die recirculation channels (105) via the second-sized inlet port (125). The pumps (135) may then cause the fluid to pass through a firing chamber formed within the die (100) and along at least one of the chamber recirculation channels (120). The pumps (135) may further cause the printing fluid to pass into a fluidically coupled cross-die recirculation channels (105) via a second-sized outlet port (130).

Each of the firing chambers formed along a number of the chamber recirculation channels (120) may include a fluid ejection device such as a thermal resistor or a piezoelectric device. The fluid ejection device may eject a metered amount of fluid from the die (100) via an orifice. During operation, each individual fluid ejection device may independently eject fluid onto the surface of a print media forming an image thereon. In an example, the fluid ejection devices may be actuated to coordinate with the actuation of the pumps (135) such that an amount of fluid may be present in each of the firing chambers during firing of the fluid ejection devices. Additionally, the recirculation of the fluid through the cross-die recirculation channels (105) and chamber recirculation channels (120) prevents any pigments from separating from a liquid carrier within the fluid. This maintains the print quality of the printed media through, at least, a print job.

Figure 2:
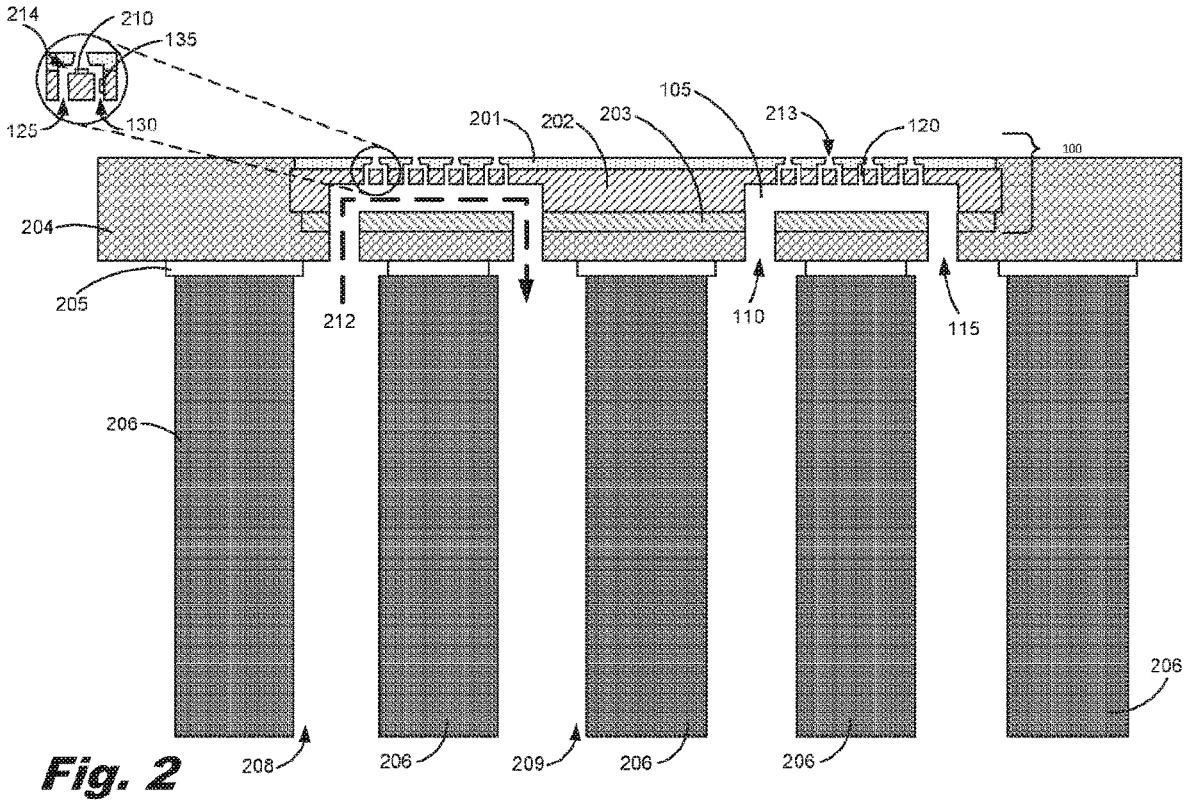
FIG. 2 is a cross-sectional view of a die (100) coupled to a housing according to an example of the principles described herein.

FIG. 2 is a cross-sectional view of a fluid ejection system (200) according to an example of the principles described herein. The fluid ejection system (200) may include a die (100) that may have a number of layers. Among these layers may be an orifice layer (201), a silicon layer (202), and an interposer layer (203). The orifice layer (201) may be made of, for example, phosphosilicate glass (PSG), undoped silicate glass (USG), borophosphosilicate glass (BPSG), stainless steel sheet, polymer, or combinations thereof. Other types of material may be used to form the orifice layer (201) and the present specification contemplates the use of those other materials. In an example, the total thickness across the orifice layer (201), silicon layer (202), and interposer layer (203) may be between 700 and 720 micrometers. In an example, the total thickness across the orifice layer (201), silicon layer (202), and interposer layer (203) may be 710 micrometers.

The orifice layer (201) may have, formed therethrough, at least one orifice (213). The orifice (213) may have any dimensions and is used as a conduit through which a fluid ejection device (210) ejects fluid from the die (100). The silicon layer (202) may be made of silicon and may form the portion of the die (100) into which the chamber recirculation channels (120) are formed. Additionally, as can be seen in the cut-away view presented in FIG. 2, the silicon layer (202) forms a fluid ejection chamber (214) with the orifice layer (201). Positioned inside the fluid ejection chamber (214) and below the orifice (213) is the fluid ejection device (210). Additionally, any of the chamber recirculation channels (120) may include therein a pump (135) to recirculate the fluid from the cross-die recirculation channels (105), through the second-sized inlet port (125), through the fluid ejection chamber (214), across the fluid ejection device (210), and out of the second-sized outlet port (130), and back into the cross-die recirculation channels (105).

The interposer layer (203) of the die (100) may, in an example, be made of silicon. FIG. 2 shows an example of a cross-die recirculation channel (105) formed, at least partially, through the die (100) and specifically the interposer layer (203) and the silicon layer (202). The cross-die recirculation channels (105) may be supplied with fluid via a number of slots (208, 209). The slots (208, 209) may be defined by a die carrier (206) made of, for example polyphenylene sulfide (PPS) and liquid crystal polymers (LOP) mixture, and a reverb insert (207) made of, for example, a plastic. In an example, fluid may be provided into the slots (208, 209) via, for example, a pump. During operation, the fluid within the slots (208, 209) may be forced through the cross-die recirculation channels (105) as indicated by the fluid flow path (212). The pumps (135) within the chamber recirculation channels (120) may then draw an amount of fluid through the chamber recirculation channels (120) as described herein. Unused fluid is pushed back into the cross-die recirculation channels (105) and may be sent back out of the die (100) and into the slots (208, 209). This recirculation prevents the settling of, for example, pigments within the fluid thereby increasing the print quality during a print job.

In an example, the die (100) may be embedded into a substrate (204). The substrate (204) may be made of, for example, epoxy mold compound (EMC). Although FIG. 2 shows the die (100) being embedded into the substrate (204), the present specification contemplates other configurations where the die (100) is coupled to the surface of another substrate material. The present specification contemplates these other arrangements of the die (100).

In an example, the substrate (204) and die (100) may be coupled to the die carrier (206) and reverb inserts (207) via an adhesive. In an example, the adhesive is an epoxy.

FIG. 2 shows a cross-die recirculation channel (105) that appears to run the length of the die (100). However, at least a portion of the cross-die recirculation channels (105) may be defined by a number of posts and/or ribs formed laterally (i.e., behind and in front of the chamber recirculation channel (120) shown) along the length of the die (100), A number of example layouts of the cross-die recirculation channels (105) formed within the die (100) are described herein.

Figure 3:
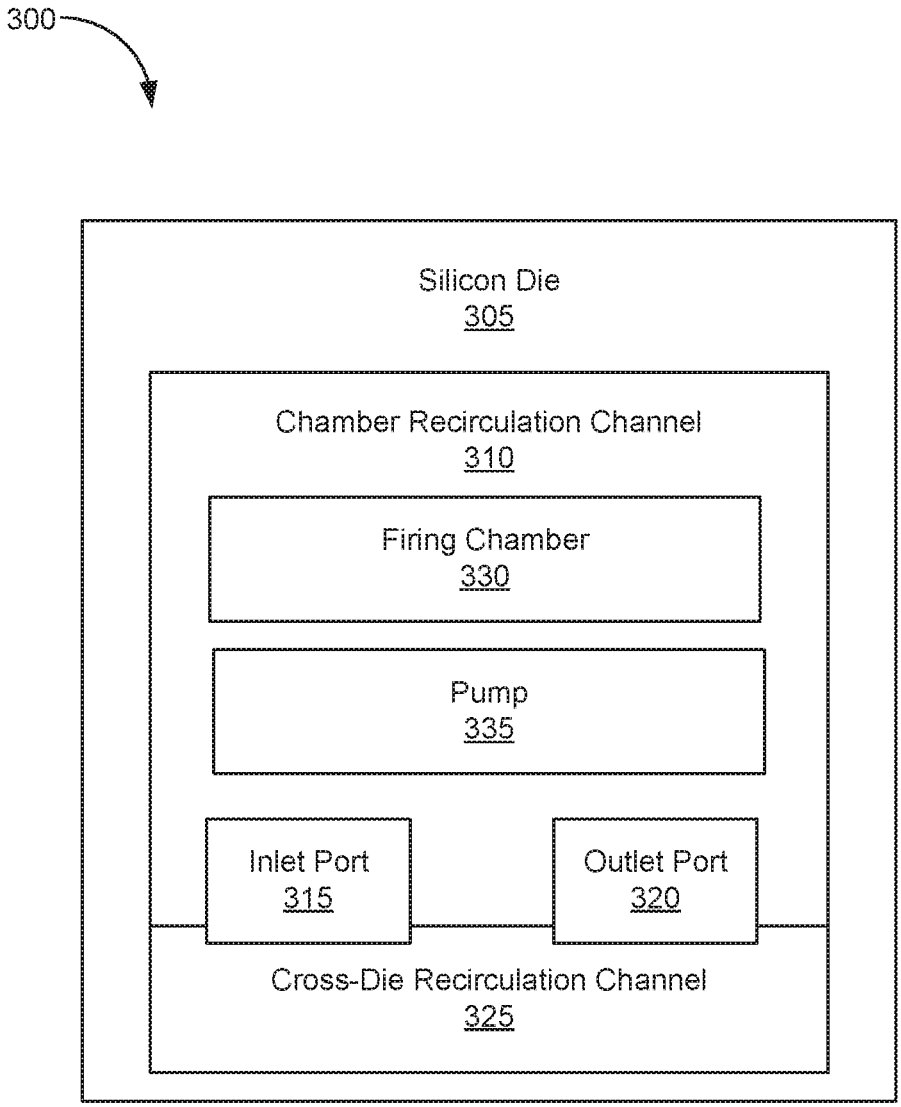
FIG. 3 is a block diagram of a device according to an example of the principles described herein.

FIG. 3 is a block diagram of a device (300) according to an example of the principles described herein. The device (300) may include a silicon die (305) having at least one chamber recirculation channel (310) formed therein that is fluidically coupled to a cross-die recirculation channel (325). The chamber recirculation channel (310) may be fluidically coupled to the cross-die recirculation channel (325) via an inlet port (315) and an outlet port (320).

The chamber recirculation channel (310) may pass through a firing chamber (330). The firing chamber (330) may include a fluid ejection device such as a thermal resistor or a piezoelectric device, Additionally, the chamber recirculation channel (310) may include a pump (335) to pull an amount of fluid from the cross-die recirculation channel (325) and into the flow of the chamber recirculation channel (310) as described herein.

Figure 4:
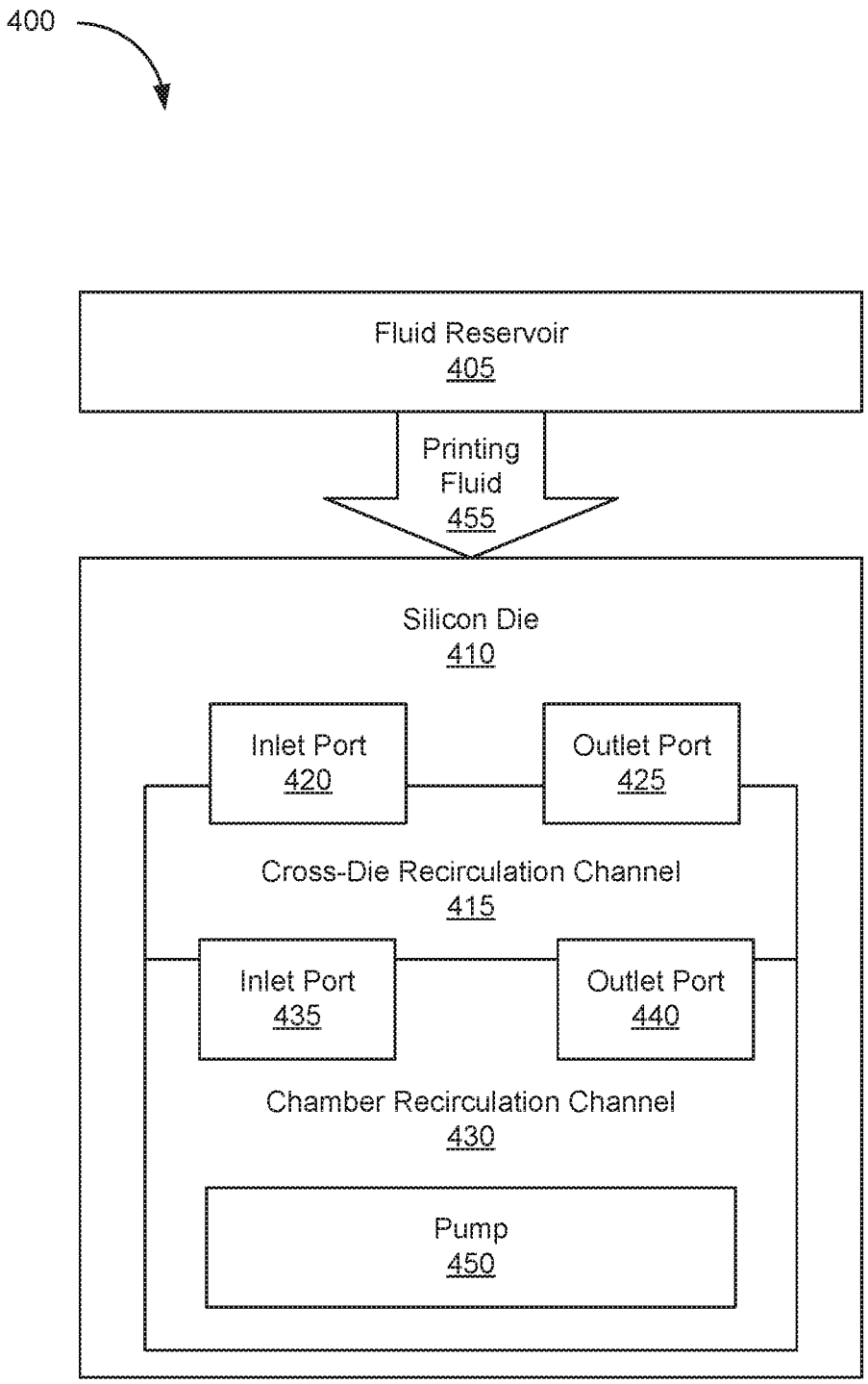
FIG. 4 is a block diagram of a fluid ejection system according to an example of the principles described herein.

FIG. 4 is a block diagram of a fluid ejection system (400) according to an example of the principles described herein. The fluid ejection system (400) may include a fluid reservoir (405) fluidically coupled to, at least, a silicon die (410). The fluid reservoir (405) provides the printing fluid (455) to the silicon die (410) via the cross-die recirculation channels (415). In an example, additional channels, slots or tubes may be coupled between the cross-die recirculation channels (415) and the fluid reservoir (405) and the present specification contemplates the use of these other fluidic connections.

The cross-die recirculation channels (415) includes a first-sized inlet port (420) and a first-sized outlet port (425) to pass an amount of printing fluid (455) into and out of, respectively, the silicon die (410). The cross-die recirculation channels (415) may have any number of first-sized inlet ports (420) and first-sized outlet ports (425). In an example, the cross-die recirculation channels (415) may be formed longitudinally along a length of the silicon die (410). In an example, the cross-die recirculation channels (415) may be formed laterally along the length of the silicon die (410). The cross-sectional area of the cross-die recirculation channels (415) may be relatively larger than the cross-sectional area of the chamber recirculation channels (430). In this example, the cross-die recirculation channels (415) may provide an amount of printing fluid (455) to a plurality of chamber recirculation channels (430).

The cross-die recirculation channels (415) and the chamber recirculation channels (430) may be fluidically coupled to each other via a second-sized inlet port (435) and a second-sized outlet port (440). The cross-sectional area of the chamber recirculation channels (430) may be on the order to $10^{-6}$ meters. The chamber recirculation channels (430) may further include at least one pump (450), The pump (450) within each of the chamber recirculation channels (430) pulls an amount of printing fluid (455) from the cross-die recirculation channels (415) and into a chamber formed within the chamber recirculation channels (430). This recirculation of printing fluid (455) through the cross-die recirculation channels (415) and chamber recirculation channels (430) prevent pigments or other solids within the printing fluid (455) from separating from the liquid carrier fluid within the printing fluid (455). Because the pump (450) pumps the printing fluid (455) out of and into the cross-die recirculation channels (415), the printing fluid (455) is continually mixed preventing the separation. Additionally, some of the printing fluid (455) recirculating through the cross-die recirculation channels (415) may not be pulled into the chamber recirculation channels (430). In this example, the silicon die (410) includes, at least, two recirculation paths for the printing fluid (455) to move further assuring that recirculation is occurring: through die recirculation with the cross-die recirculation channels (415) and through chamber recirculation through the chamber recirculation channels (430).

Each of the chamber recirculation channels (430) may further include at least one fluid ejection device within the fluid ejection chambers to eject an amount of fluid through an orifice formed on a surface of the silicon die (410) opposite the first sized input port (420) and first sized outlet port (425) of the cross-die recirculation channels (415). In an example, each of the cross-die recirculation channels (415) may have a plurality of fluid ejection chambers formed therein with each of the fluid ejection chambers including a fluid ejection device and orifice.

Figure 5:
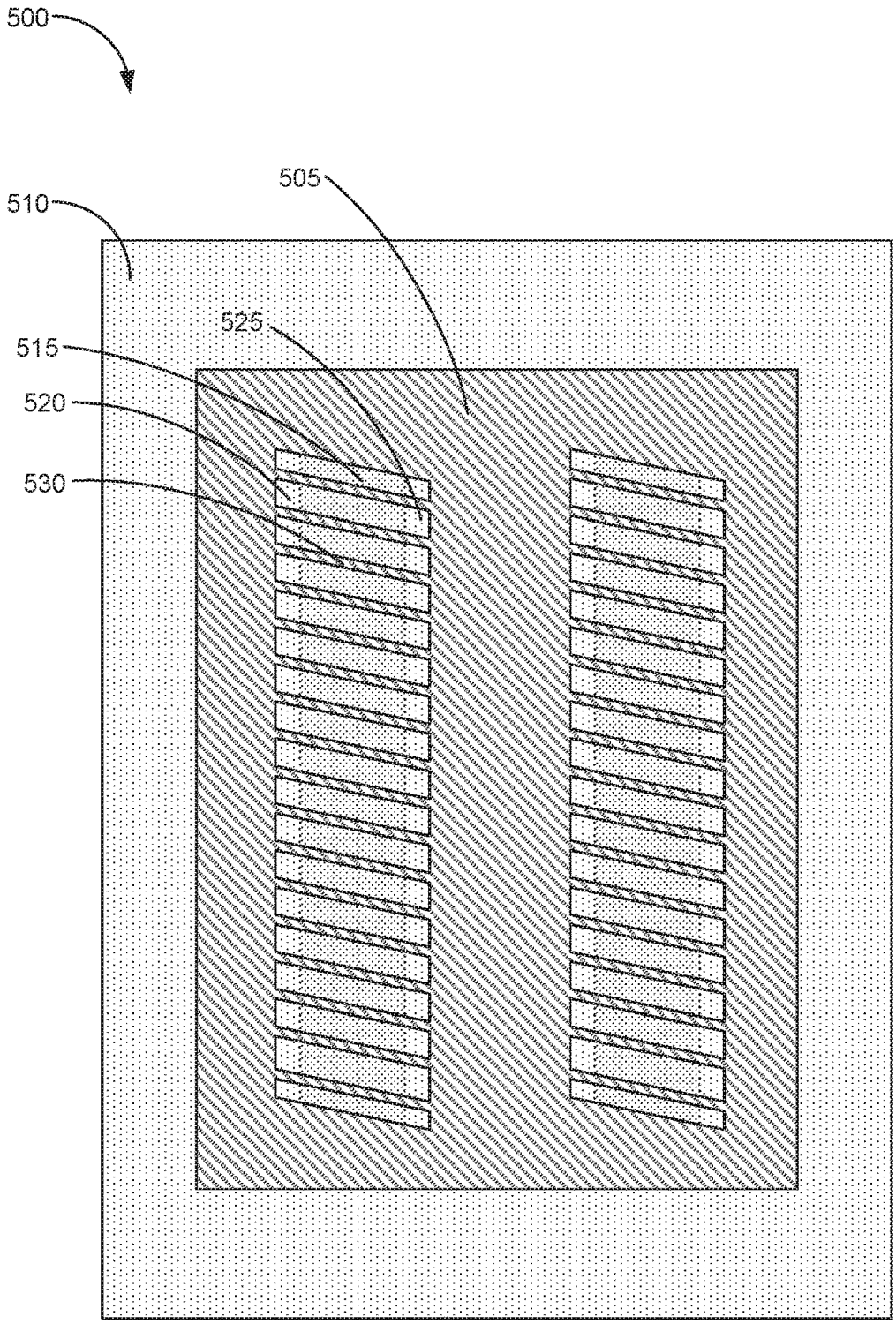
FIG. 5 is a bottom view of a die (FIG. 1, 100) according to an example of he principles described herein.

FIG. 5 is a bottom view of a die (500) according to an example of the principles described herein, FIG. 5 shows an interposer layer (505) in front of a silicon layer (510). In this example, orifice layer (FIG. 2, 201) is not viewable but, instead, is layered behind the silicon layer (510) as viewed in FIG. 5. Additionally, the layout of the cross-die recirculation channels (515) presented in FIG. 5 are merely an example and the present specification contemplates other layouts as described herein.

The cross-die recirculation channels (515) cross-die recirculation channels (515) in the present example are presented in a slanted configuration such that the cross-die recirculation channels (515) enter through the interposer layer (505) and into the silicon layer (510), across the silicon layer (510) at a slant, and back out of the silicon layer (510) and interposer layer (505) at a relatively lower location along the surface of the interposer layer (505). Each of the cross-die recirculation channels (515) include an inlet port (520) and an outlet port (525) as described herein. As a result of the view of FIG. 5, a bottom surface of the silicon layer (510) is seen through the inlet ports (520) and outlet ports (525). A cross-die section of the cross-die recirculation channels (515) may be formed through the silicon layer (510) and blocked from view by the interposer layer (505) as indicated by the dashed lines.

In the example of FIG. 5, the formation of the cross-die recirculation channels (515) creates ribs (530) between each of the cross-die recirculation channels (515). The ribs (530) may provide support between the silicon layer (510) and interposer layer (505). The formation of the cross-die recirculation channels (515) in FIG. 5 may be referred to as a cross-flow configuration because the flow of fluid through the cross-die recirculation channels (515) crosses the die (500) laterally.

In an example, the formation of the cross-die recirculation channels (515) may form ribs (530) that are between a 70 and 160 dpi pitch. In an example, the ribs (530) are at a 150 dpi pitch. In an example, the ribs (530) are at a 75 dpi pitch.

Figure 6A:
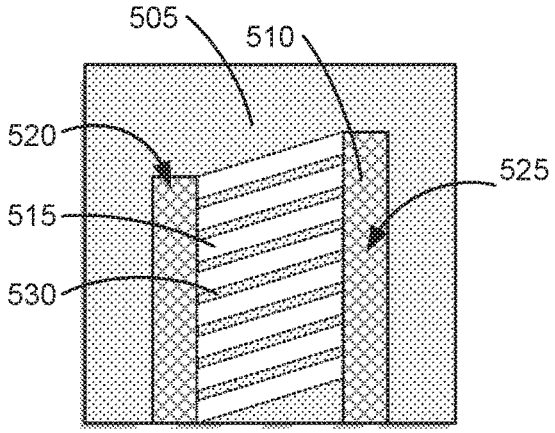
FIGS. 6A-6G show a number of examples of layouts of the cross-die recirculation channels shown in FIG. 5 according to an example of the principles described herein.

FIGS. 6A-6G show a number of examples of layouts of the cross-die recirculation channels shown in FIG. 5 according to an example of the principles described herein. Each of the examples shown in FIGS. 6A-6G are examples of a cross-flow configuration because the flow of fluid through the cross-die recirculation channels (515) crosses the die (500) laterally. FIG. 6A shows a slanted enclosed slot configuration with each of the cross-die recirculation channels (515) crossing through the silicon layer (510) at an angle.

In this example, the angle may be between 25 to 35 degrees relative to the edge of the silicon die (FIG. 4, 410). In an example, the angle may be 30 degrees relative to the edge of the silicon die (FIG. 4, 410). In an example, the width of the rib (530) may be between 70 and 90 micrometers. In an example, the width of the rib (530) may be 80 micrometers. In an example, the width of the cross-die recirculation channels (515) may be between 300 and 500 micrometers. In an example, the width of the cross-die recirculation channels (515) may be 400 micrometers. In the example shown in FIG. 6A, the ribs (530) may extend across each of the inlet ports (520) and outlet ports (525). In another example, the ribs (530) do not extend across the inlet ports (520) and outlet ports (525) and would, therefore, not be viewable through the inlet ports (520) and outlet ports (525) when viewed at the angle seen in FIG. 6A.

Figure 6B:
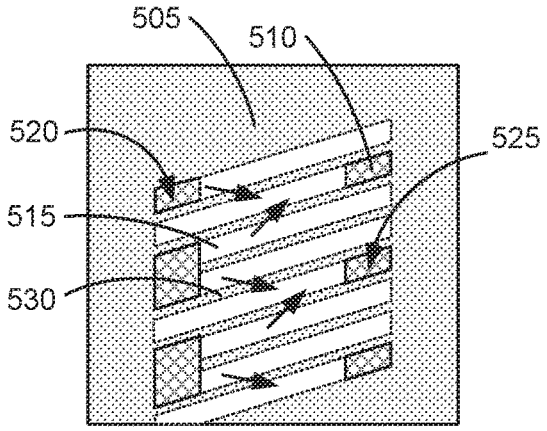

FIG. 6B is an example of the cross-die recirculation channels (515) that are also slanted. However, the inlet ports (520) and outlet ports (525) may be staggered along the ends of the cross-die recirculation channels (515) such that fluid flow (as shown by the arrows) flows from one inlet port (520) through a number of fluid ejection chambers and into a neighboring cross-die recirculation channel (515) before exiting through an outlet port (525).

Figure 6C:
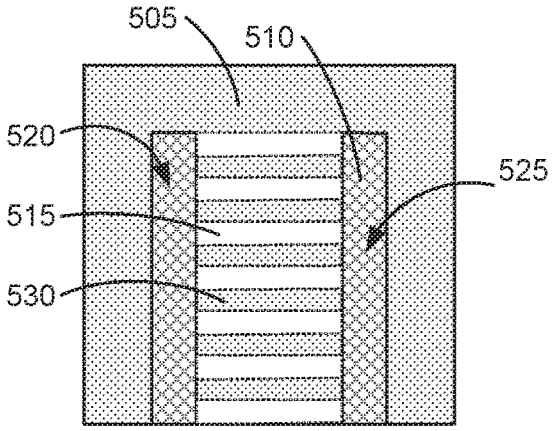

FIG. 6C may be a variant of FIG. 6A but instead of slanted ribs (530) and cross-die recirculation channels (515), the ribs (530) and cross-die recirculation channels (515) are perpendicular to an edge surface of the silicon die (FIG. 4, 410). In this example, the fluid may enter the inlet ports (520) pass through the cross-die recirculation channels (515) and exit out of the outlet ports (525). The width of the ribs (530) may be 50 micrometers with a cross-die recirculation channels (515) width of 290 micrometers.

Figure 6D:
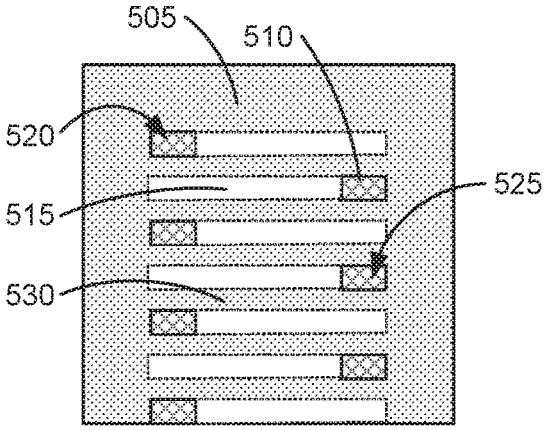

FIG. 6D may be a variant of FIG. 6B but instead of slanted ribs (530) and cross-die recirculation channels (515), the ribs (530) and cross-die recirculation channels (515) are perpendicular to an edge surface of the silicon die (FIG. 4, 410). In this example, the fluid may pass into an inlet port (520) pass, at least partially through the cross-die recirculation channel (515) across a fluid ejection chamber, through the cross-die recirculation channels (515) again, and out of an outlet port (525).

Figure 6E:
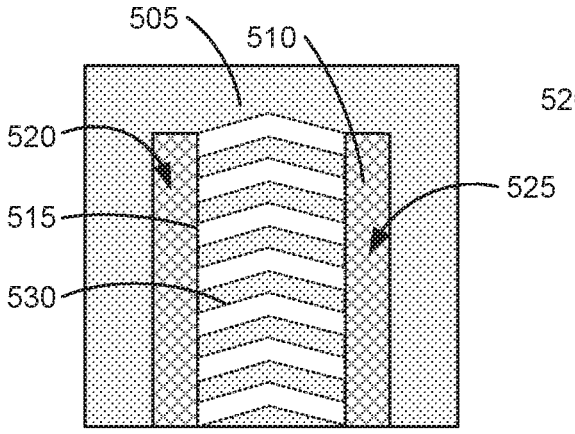

FIG. 6E may be a variant of FIG. 6C except that the cross-die recirculation channels (515) are formed into chevrons. The angle formed by the chevron-shaped cross-die recirculation channels (515), in an example, may be 30 degrees. In this example, the fluid may enter the inlet ports (520) pass through the cross-die recirculation channels (515) and exit out of the outlet ports (525). In an example, the chevron ribs (530) formed by the chevron shaped cross-die recirculation channels (515) may have a width of 80 micrometers with the cross-die recirculation channels (515) having a width of 400 micrometers.

Figure 6F:
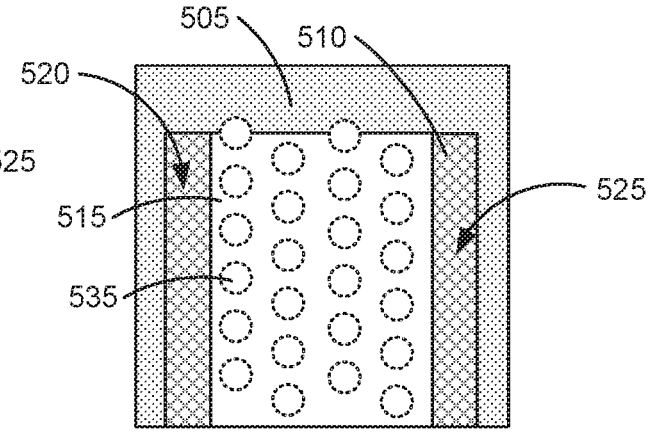

FIG. 6F shows a number of posts (535) formed within a cross-die recirculation channel (515). The posts (535) may be of any size and may vary by pattern including a slanted patter, a chevron pattern, or any other pattern. In an example, the posts may have a diameter of 100 micrometers. In an example, the posts may be formed into lines either that are straight, slanted, or chevron shaped.

Figure 6G:
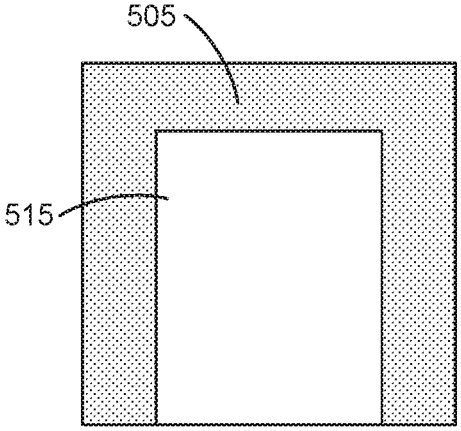

FIG. 6G includes a single cross-die recirculation channel (515) that spans across the silicon die (FIG. 4, 410) under the orifices of the silicon die (FIG. 4, 410) without any ribs (530) or posts (535). In this example, the inlet ports (520) and outlet ports (525) may be the same port with the cross-die recirculation channel (515) being formed into a single channel. The width of the cross-die recirculation channels (515) may be 3.151 millimeters.

FIGS. 7A-7E show a number of examples of layouts of the cross-die recirculation channels shown in FIG. 5 according to an example of the principles described herein. Each of the examples shown in FIGS. 7A-7E are examples of a longitudinal-flow configuration because the flow of fluid through the cross-die recirculation channels (515) crosses the die (500) longitudinally.

Figure 7A:
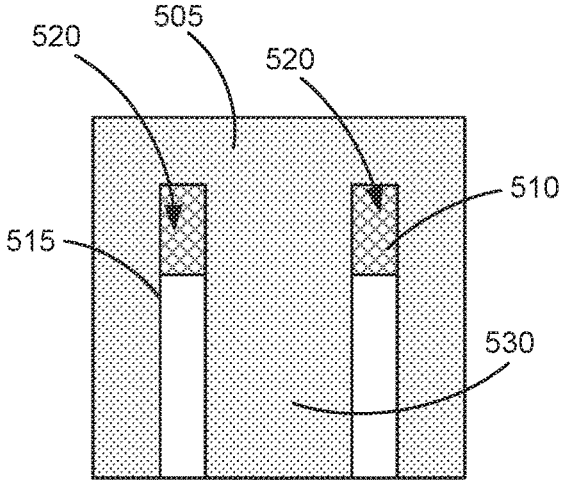
FIGS. 7A-7E show a number of examples of layouts of the cross-die recirculation channels shown in FIG. 5 according to an example of the principles described herein.

FIG. 7A shows two cross-die recirculation channels (515) that span the length of the silicon die (FIG. 4, 410) longitudinally. In this example, the inlet ports (520) may be on one end of the silicon die (FIG. 4, 410) at the beginning of the cross-die recirculation channels (515). In this example, the outlet ports (525) may be located at the other end of the silicon die (FIG. 4, 410). In another example, an inlet port (520) and an outlet port (525) for each of the individual cross-die recirculation channels (515) may be on the same end of the silicon die (FIG. 4, 410).

Figure 7B:
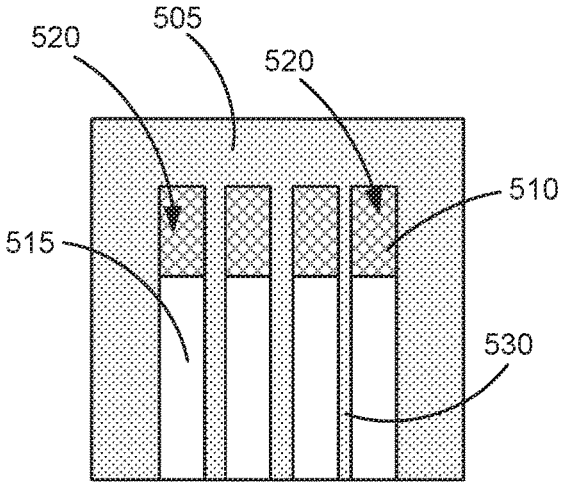

FIG. 7B is a variant of FIG. 7A except that there are multiple cross-die recirculation channels (515) with their inlet ports (520) and outlet ports (525). In this example, the inlet ports (520) may be on one end of the silicon die (FIG. 4, 410) at the beginning of the cross-die recirculation channels (515). In this example, the outlet ports (525) may be located at the other end of the silicon die (Fig, 4, 410). In another example, an inlet port (520) and an outlet port (525)

for each of the individual cross-die recirculation channels (515) may be on the same end of the silicon die (FIG. 4, 410).

Figure 7C:
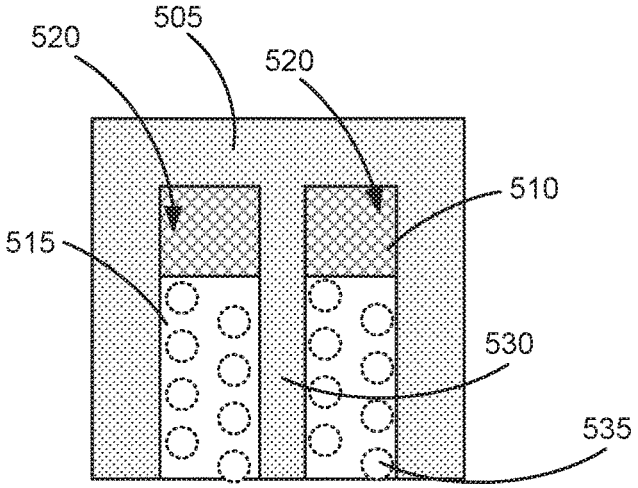

FIG. 7C is a variant of FIG. 7A, except in this example the cross-die recirculation channels (515) may include a number of posts (535) within, at least, a portion of the cross-die recirculation channels (515). In this example, the inlet ports (520) may be on one end of the silicon die (FIG. 4, 410) at the beginning of the cross-die recirculation channels (515). In this example, the outlet ports (525) may be located at the other end of the silicon die (FIG. 4, 410). In another example, an inlet port (520) and an outlet port (525) for each of the individual cross-die recirculation channels (515) may be on the same end of the silicon die (FIG. 4, 410).

Figure 7D:
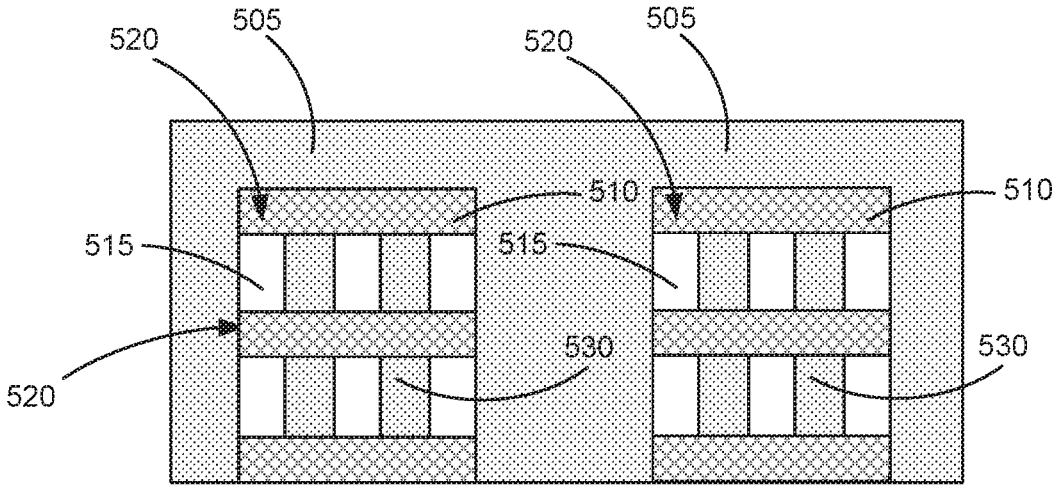
Figure 7E:
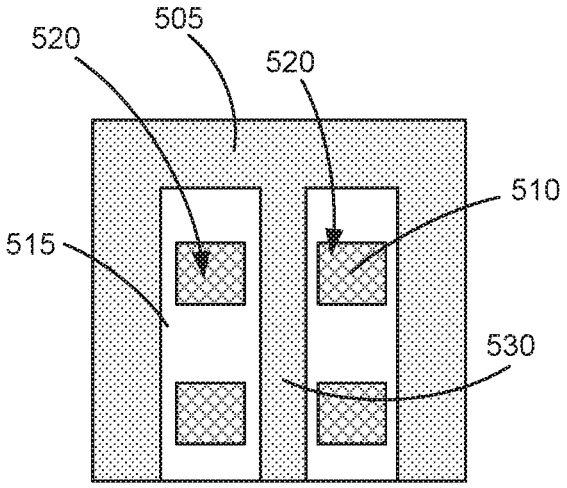

FIG. 7D shows a variant of FIG. 7A, except in this example the cross-die recirculation channels (515) may include either an inlet port (520) and/or and outlet port (525) along the length of the cross-die recirculation channels (515). FIG. 7E shows a variant of FIG. 7A except in this example, the cross-die recirculation channels (515) span the length of the silicon die (FIG. 4, 410) with either an inlet port (520) or outlet port (525) formed along the cross-die recirculation channels (515). In an example, the square shape of the inlet ports (520) and/or outlet ports (525) may be 1 millimeter by 1.09 millimeters with a distance between any inlet ports (520) and/or outlet ports (525) being 4.91 millimeters, In an example, the square shape of the inlet ports (520) and/or outlet ports (525) may be 1 millimeter by 0.61 millimeters with a distance between any inlet ports (520) and/or outlet ports (525) being 4.91 millimeters.

Figure 8:
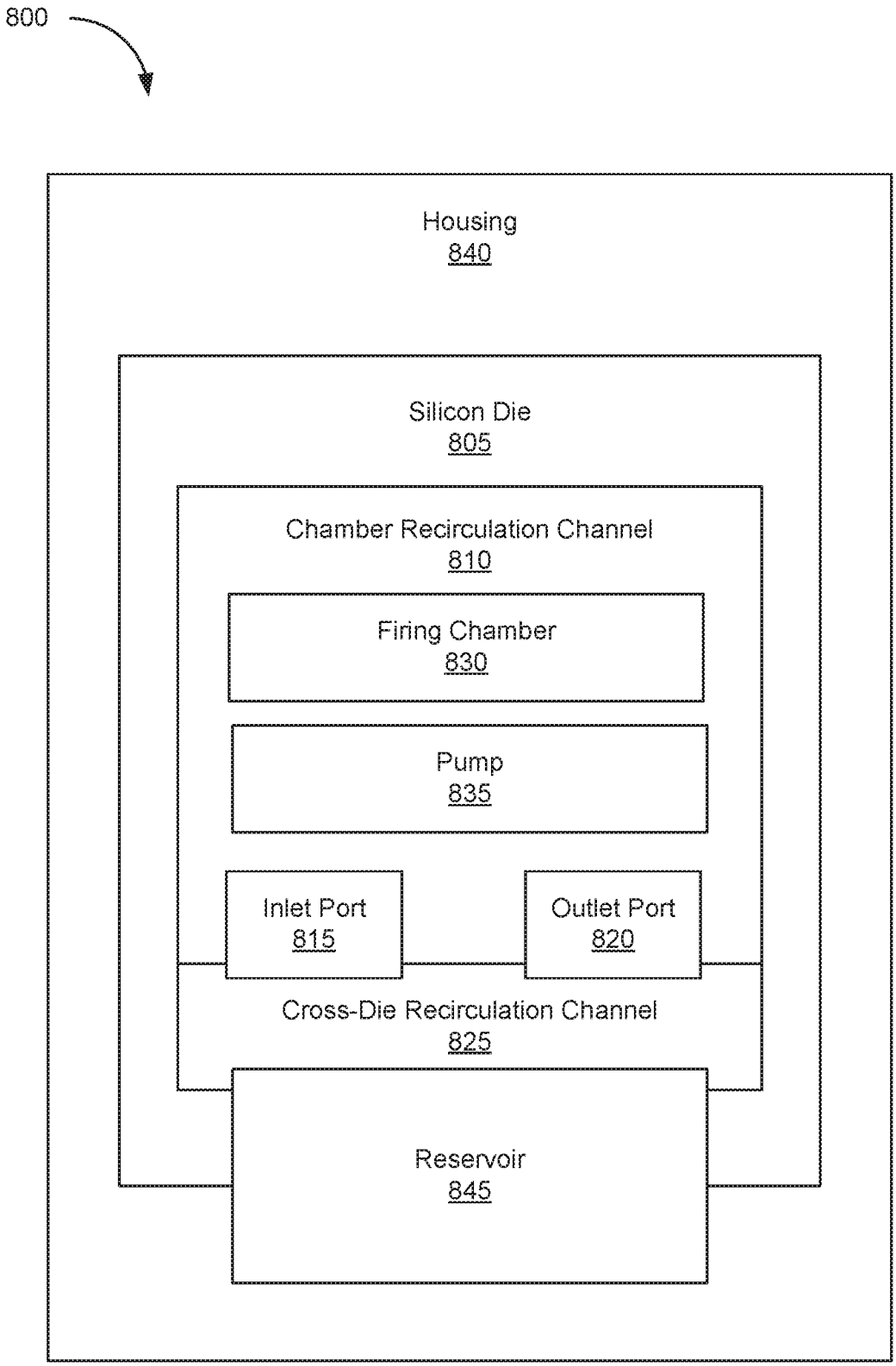
FIG. 8 is a block diagram of a device (800) according to an example of the principles described herein, Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

FIG. 8 is a block diagram of a device (800) according to an example of the principles described herein. Similar to FIG. 3, the device (800) may include a silicon die (805) having at least one chamber recirculation channel (810) formed therein that is fluidically coupled to a cross-die recirculation channel (825), The chamber recirculation channel (810) may be fluidically coupled to the cross-die recirculation channel (825) via an inlet port (815) and an outlet port (820).

The chamber recirculation channel (810) may pass through a firing chamber (830). The firing chamber (830) may include a fluid ejection device such as a thermal resistor or a piezoelectric device. Additionally, the chamber recirculation channel (810) may include a pump (835) to pull an amount of fluid from the cross-die recirculation channel (825) and into the flow of the chamber recirculation channel (810) as described herein.

The device (800) may further include a housing (840) and a reservoir (845), The housing (840) may be coupled to one or more elements of the device (800). In an example, the silicon die (805) may be directly coupled to the housing (840) thereby supporting the silicon die (805) during operation. In an example, the housing (840) is made of a plastic.

The reservoir (845) may be any type of reservoir that can hold a fluid therein. In an example, fluid is a printing fluid such as inks, toners, varnishes, powders, colorants, finishes, gloss enhancers, binders, and/or other such materials that may be utilized in a printing process. The reservoir (845) is fluidically coupled to, at least, the cross-die recirculation channel (825). During operation, the reservoir (845) may provide an amount of fluid to the cross-die recirculation channel (825) such that the fluid is recirculated through the chamber recirculation channel (810), the cross-die recirculation channel (825), and/or the firing chamber (830) as described herein. Various other devices may be used to provide the fluid to at least a number of input ports of the cross-die recirculation channel (825) as described herein, The specification and figures describe a cross-die recirculation channel that is fluidically coupled to a chamber recirculation channel used to recirculate fluid through the die. Recirculation of the fluid through the die as well as through the firing chambers prevents, in some examples, pigments from separating from the carrier fluids within the fluid. The by-pass fluidic flow from the cross-die recirculation channel further prevents decapping due to insufficient fluid being provided to the firing chambers. The chamber recirculation channel may further include a pump to pump fluid from the cross-die recirculation channel and through the chamber recirculation channel. In some examples, backside silicon micro channels may be strategically located adjacent to the inkjet architecture region and the fluid velocity through the chamber recirculation channel can transfer heat effectively from silicon die to the fluid to cool off the die. Some of the example die formations may be used for single colors of fluid while others may be used for multiple colors.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die, comprising:

at least one cross-die recirculation channel formed into the die, the cross-die recirculation channel including a first-sized inlet port and a first-sized outlet port formed on a first side of the die;

at least one chamber recirculation channel formed into the die and fluidically coupled to the cross-die recirculation channel, the chamber recirculation channel including a second-sized inlet port and a second-sized outlet port, wherein both the second-sized inlet port and the second-sized outlet port of a chamber recirculation channel are fluidly coupled to a portion of a cross-die recirculation channel; and at least one pump formed within the chamber recirculation channel.

2. The die of claim 1, wherein a plurality of colors of printing fluid are fluidically coupled to at least one of a plurality of chamber recirculation channels formed into the die.

3. The die of claim 1, wherein the at least one chamber recirculation channel is routed through at least one firing chamber defined in the die.

4. The die of claim 1, wherein the at least one pump pulls the printing fluid from the cross-die recirculation channel and through a firing chamber formed in the die.

5. The die of claim 1, wherein the at least one cross-die recirculation channel creates a lateral cross flow across the die to connect the at least one chamber recirculation channel to the at least one cross-die recirculation channel.

6. The die of claim 1, wherein the at least one cross-die recirculation channel runs longitudinally across the die to connect the at least one chamber recirculation channel to the at least one cross-die recirculation channel.

7. The die of claim 1, wherein the at least one cross-die recirculation channel is slanted relative to an edge of the die.

8. The die of claim 1, further comprising a number of posts disposed within the at least one cross-die recirculation channel.

9. The die of claim 1, wherein the at least one cross-die recirculation channel comprises a chevron-shaped channel.

10. The die of claim 1, wherein the at least one chamber recirculation channel is formed underneath an orifice of a fluid ejection device.

11. The die of claim 1, wherein the first-sized inlet port and a first-sized outlet port are staggered along ends of an associated cross-die recirculation channel.

12. A device, comprising:

at least one chamber recirculation channel formed into a silicon die fluidically coupled via an inlet port and an output port to at least one cross-die recirculation channel formed into the silicon die;

a firing chamber formed along the at least one chamber recirculation channel; and at least one pump formed along a portion of the at least one chamber recirculation channel to draw an amount of printing fluid from the cross-die recirculation channel and through the firing chamber.

13. The device of claim 12, wherein the at least one cross-die recirculation channel creates a lateral cross flow across the silicon die to connect the at least one chamber recirculation channel to the cross-die recirculation channel.

14. The device of claim 12, wherein the at least one cross-die recirculation channel runs longitudinally across the silicon die to connect the at least one chamber recirculation channel to the at least one cross-die recirculation channel.

15. The device of claim 12, wherein the device is incorporated into a cartridge.

16. The device of claim 12, wherein the at least one cross-die recirculation channel:

is slanted relative to an edge of the die; and comprises a number of posts disposed within.

17. A fluid ejection system, comprising:

a fluid reservoir to maintain an amount of printing fluid therein;

a slot to provide fluid to at least one cross-die recirculation channel;

at least one cross-die recirculation channel formed into a silicon die to recirculate an amount of the printing fluid therethrough, the cross-die recirculation channel including a first-sized inlet port and a first-sized outlet port formed on a first side of the silicon die;

at least one chamber recirculation channel formed into the silicon die and fluidically coupled to the cross-die recirculation channel to recirculate an amount of the printing fluid therethrough, the chamber recirculation channel including a second-sized inlet port and a second-sized outlet port, wherein both the second-sized inlet port and the second-sized outlet port of a chamber recirculation channel are fluidly coupled to a portion of a cross-die recirculation channel; and at least one pump formed within the chamber recirculation channel to recirculate the amount of the printing fluid therethrough.

18. The fluid ejection system of claim 17, wherein the at least one chamber recirculation channel is routed through at least one firing chamber defined in the silicon die.

19. The fluid ejection system of claim 17, wherein the at least one cross-die recirculation channel creates a lateral cross flow across the silicon die to connect the at least one chamber recirculation channel to the at least one cross-die recirculation channel.

20. The fluid ejection system of claim 17, wherein the at least one cross-die recirculation channel runs longitudinally across the silicon die to connect the at least one chamber recirculation channel to the at least one cross-die recirculation channel.

* * * * *